US006354884B1

(12) United States Patent
Yeh et al.

(10) Patent No.: US 6,354,884 B1
(45) Date of Patent: Mar. 12, 2002

(54) MODULAR JACK CONNECTOR WITH ANTI-MISMATING DEVICE

(75) Inventors: Joel Jyh-Haur Yeh, San Gabrie, CA (US); Leonard K. Espenshade, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/698,699

(22) Filed: Oct. 27, 2000

(51) Int. Cl.[7] ..... H01R 13/64

(52) U.S. Cl. ..... 439/680; 439/296; 439/374; 439/490

(58) Field of Search ..... 439/680, 676, 439/677, 678, 374, 296, 490

(56) References Cited

U.S. PATENT DOCUMENTS 4,781,626 A * 11/1988 Lazarchik ..... 439/680
6,059,578 A * 5/2000 Arnett ..... 439/43
6,116,946 A * 12/2000 Lewis et al. ..... 439/490
6,186,835 B1 * 2/2001 Cheshire ..... 439/676
6,257,935 B1 * 7/2001 Zhang et al. ..... 439/680
6,273,761 B1 * 8/2001 Hsu et al. ..... 439/676

* cited by examiner

*Primary Examiner*—Paula Bradley
*Assistant Examiner*—Truc Nguyen
(74) *Attorney, Agent, or Firm*—Wei Te Chung

(57) ABSTRACT

An RJ-45 modular jack connector includes a housing defining a cavity for receiving an RJ-45 plug connector therein, a terminal insert assembled to the housing, an anti-mismating device assembled in the housing and a shield covering the housing. The anti-mismating device comprises a block part and a spring part secured to the block part. The block part with the spring part is assembled in the housing with the block part partly projecting into the cavity of the housing. When the RJ-45 plug connector is inserted into the modular jack receptacle connector, the RJ-45 plug connector pushes the block part to the side, compressing the spring part and moving the block part out of the way of the RJ-45 plug connector. Thus the RJ-45 plug connector is fully inserted into the cavity of the housing. When an RJ-11 plug connector is mistakenly inserted into the modular jack connector, the smaller RJ-11 plug connector will not move the block part aside and be blocked by the block part from full insertion into the cavity.

1 Claim, 3 Drawing Sheets

MODULAR JACK CONNECTOR WITH ANTI-MISMATING DEVICE

FIELD OF THE INVENTION

The present invention relates to a connector, and more particularly to a modular jack connector with an anti-mismating device therein for blocking insertion of any other plug connectors except a complementary plug connector.

BACKGROUND OF THE INVENTION

RJ-45 plug and modular jack connectors have larger dimensions than RJ-11 plug and modular jack connectors. In actual use, an RJ-11 plug connector may be inadvertently inserted into an RJ-45 modular jack connector, especially when the RJ-45 and RJ-11 modular jack connectors are arranged in a side-by-side manner. As a matter of fact, RJ-45 and RJ-11 modular jack connectors have become a standard interface in notebook computers and they are typically arranged in a side-by-side manner. An incorrect insertion of the RJ-11 plug connector into the RJ-45 modular jack connector can damage terminals within the RJ-45 modular jack connector, in addition to other possible electrical damage. Accordingly, providing an RJ-45 receptacle connector which can effectively prevent incorrect insertion of an RJ-11 plug connector is conspicuously needed in the computer industry.

A modular jack connector usually has a pair of LEDs (Light-Emitting Diode) assembled to its upper comers for show when it is transmitting signals. To prevent incorrect insertion of a plug connector of another type, related modular jack connectors employ anti-mismating devices. However, these anti-mismating devices occupy the place of the LEDs, thereby preventing use of LEDs in these modular jack connectors. Hence, an improved anti-mismating device for a modular jack receptacle connector is required to overcome the disadvantages of the prior art.

BRIEF SUMMARY OF THE INVENTION

An object of the present invention is to provide an RJ-45 modular jack connector having an anti-mismating device for blocking insertion of any other connectors except a complementary plug connector.

In order to achieve the object set forth, an RJ-45 modular jack connector comprises a housing defining a cavity for receiving an RJ-45 plug connector therein, a terminal insert assembled to the housing, an anti-mismating device assembled in the housing and a shield covering the housing. The anti-mismating device comprises a block part and a spring part secured to the block part. The block part with the spring part is assembled in the housing with the block part partly projecting into the cavity of the housing. When the RJ-45 plug connector is inserted into the modular jack receptacle connector, the RJ-45 plug connector pushes the block part to the side, compressing the spring part and moving the block part out of the way of the RJ-45 plug connector. Thus the RJ-45 plug connector is fully inserted into the cavity of the housing. When an RJ-11 plug connector is mistakenly inserted into the modular jack connector, the smaller RJ-11 plug connector will not move the block part aside and be blocked by the block part from fill insertion into the cavity.

Other objects, advantages and novel features of the invention will become more apparent from the following detailed description of the present embodiment when taken in conjunction with the accompanying drawings.

DETAILED DESCRIPTION OF THE INVENTION

Figure 1:
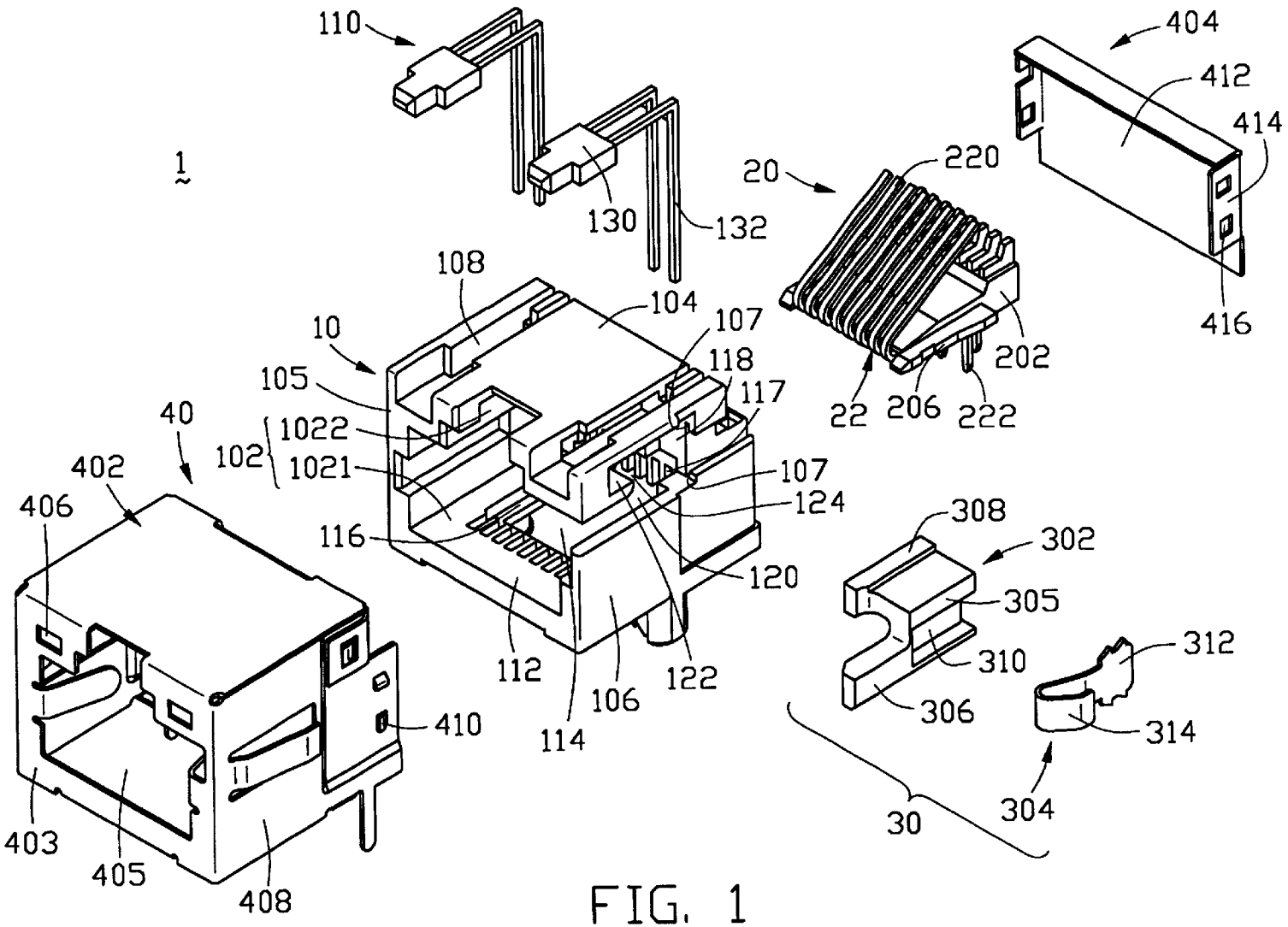
FIG. 1 is an exploded view of a modular jack receptacle connector in accordance with the present invention.

Referring to FIG. 1, an RJ-45 modular jack connector 1 in accordance with the present invention comprises an insulative housing 10, a terminal insert 20 with a plurality of terminals 22 insert molded therewith, a pair of LEDs (Light-Emitting Diodes) 110, an anti-mismating device 30, and a shield 40.

The housing 10 has a rectangular shape and defines a cavity 102 therein. A lower part of the cavity 102 (labeled 1021) receives a body of an RJ-45 plug connector (not shown) therein and an upper part of the cavity 102 (labeled 1022) receives a latch (not shown) of the RJ-45 plug connector. The plug connector may be referred to FIG. 8 of U.S. Pat. No. 6,129,587 having the same assignee with the instant application. The upper part 1022 is narrower than the lower part 1021 of the cavity 102. A pair of slots 108 is respectively defined in an upper wall 104 of the housing 10 proximate a left side wall 105 and a right side wall 106 of the housing 10, for receiving the LEDs 110. A parallel plate 122 extends parallel to the upper wall 104 adjacent the right side wall 106, below the corresponding slot 108. A receiving space 124 is defined in the right side wall 106 beneath the upper wall 104 and in communication with the upper part 1022 of the cavity 102. The right side wall 106 is partly cut out to define a first space 120 between the parallel plate 122 and the partly cut side wall 106. An opening 114 is defined in a bottom wall 112 of the housing 10. A pair of steps 116 is formed at opposite sides of the opening 114 of the housing 10. A rear wall 118 of the housing 10 extends from an upper wall 104 partway down a rear side of the housing 10. A plurality of spaced grooves 117 is defined in a lower end of the rear wall 118. A pair of opposite channels 107 is defined at an upper rear end of the right side wall 106.

The LED 110 comprises an illuminant 130 and a pair of solder legs 132 extending rearwardly and downwardly from the illuminant 130.

The terminal insert 20 comprises an insulative part 202, and a plurality of terminals 22 insert molded with the insulative part 202. Each terminal 22 comprises an upwardly and rearwardly bent contact portion 220 for mating with a corresponding contact of the RJ-45 plug connector. A solder tail 222 extends downwardly from an opposite end of each terminal 22 for being soldered to a circuit board (not shown). The insulative part 202 comprises a latch 206 at each side thereof for securing the terminal insert 20 to the housing 10.

The anti-mismating device 30 comprises a block part 302 and a spring part 304. The block part 302 comprises a main portion 305, an actuating portion 306 at a front end of the main portion 305, and a blocking portion 308 extending to an inward side of the main portion 305. The main portion 305 defines a channel 310 in its outward side opposite the blocking portion 308 for receiving the spring part 304. The spring part 304 comprises a securing portion 312 for being secured to the channels 107 of the housing 10, and a spring portion 314 extending from a forward end of the securing portion 312 for being received in the channel 310 of the block part 302.

The shield 40 comprises a front part 402 and a rear part 404. The front part 402 is rectangular in shape and comprises a front plate 403 and a pair of opposite side plates 408. The front plate 403 of the front part 402 defines an opening 405 corresponding to the cavity 102 of the housing 10, and two holes 406 at upper comers thereof corresponding to forward ends of the slots 108 of the housing 10. Each side plate 408 forms a pair of tabs 410 at a rear end thereof. The rear part 404 comprises a main plate 412 and a pair of side plates 414 forwardly and perpendicularly extending from the main plate 412. Each side plate 414 defines a pair of holes 416 for engaging with the tabs 410 of the side plate 408 of the front part 402.

Figure 2:
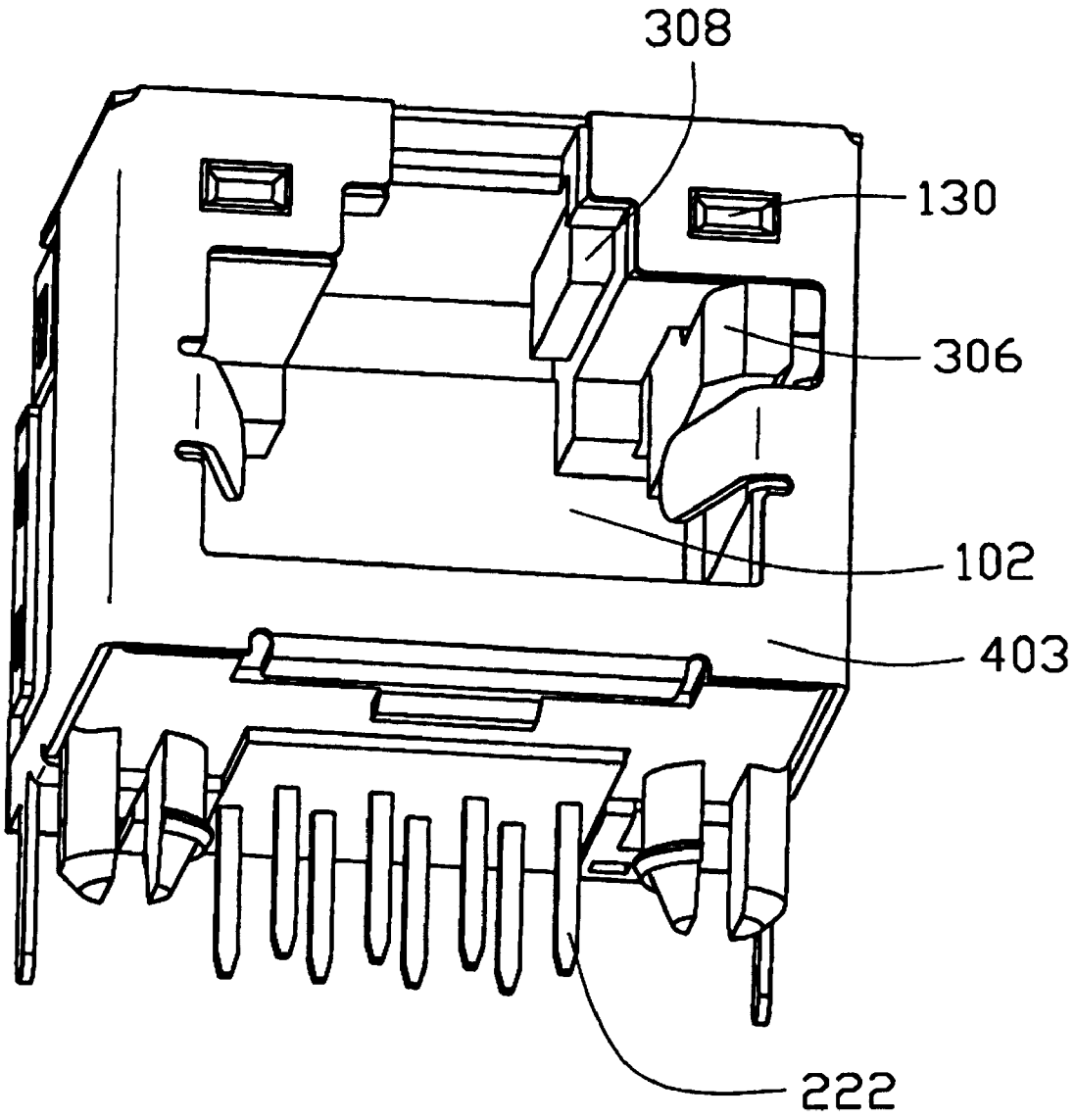
FIG. 2 is a perspective view of the assembled modular jack receptacle connector viewed from a bottom aspect.
Figure 3:
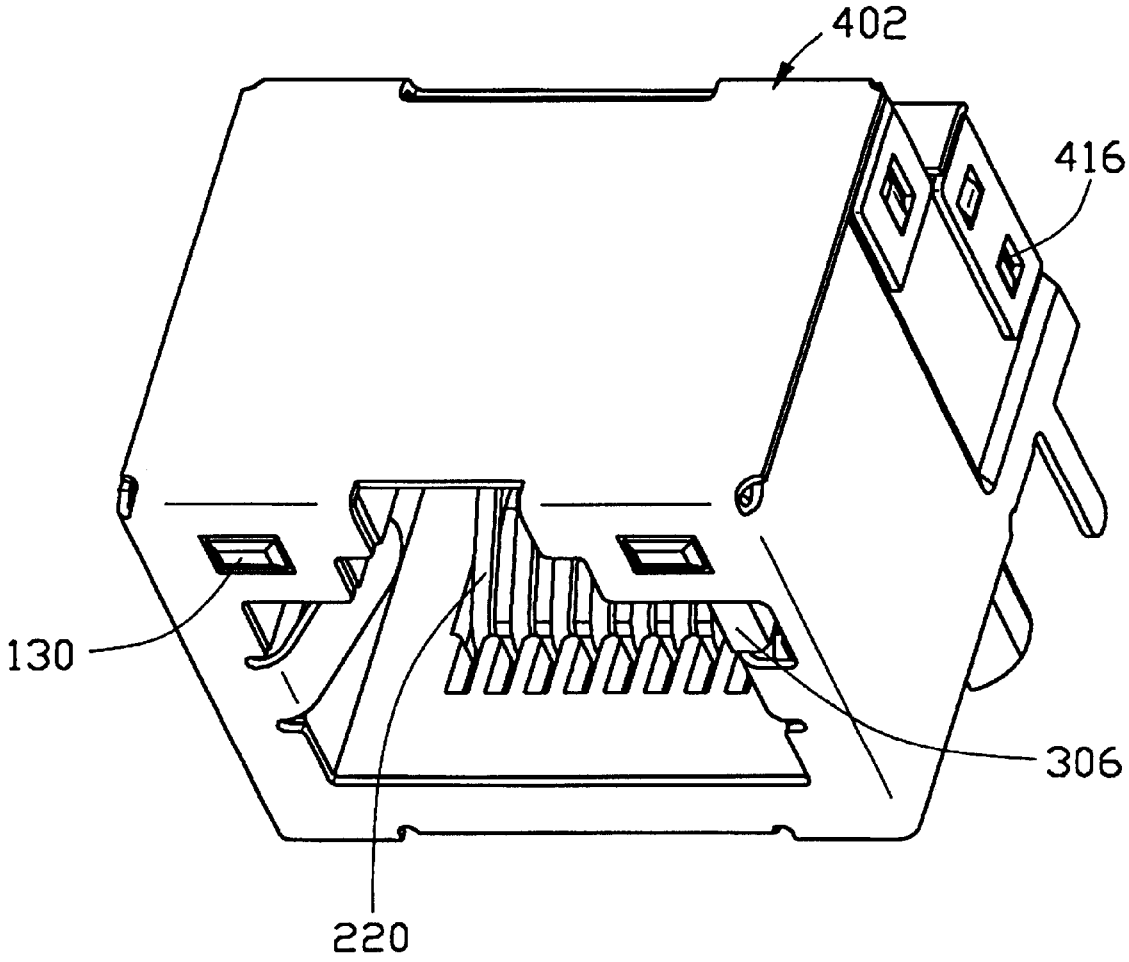
FIG. 3 is a perspective view of the assembled modular jack receptacle connector viewed from a top aspect.

Also referring to FIGS. 2 and 3, in assembly, the blocking portion 308 of the block part 302 is first received in the receiving space 124 and partly projects into the upper part 1022 of the cavity 102 in the housing 10. The actuating portion 306 extends into the lower part 1021 of the cavity 102 from the first space 120, and the main portion 305 is stopped by the parallel plate 122. Opposite sides of the securing portion 312 of the spring part 304 are then secured to the channels 107 of the housing 10, and the spring portion 314 is correspondingly received in the channel 310 of the block part 302.

The terminal insert 20 is inserted into the cavity 102 from the rear side of the housing 10 and is received in the opening 114 of the housing 10 from rear with both latches 206 of the insulative part 202 engaging with the steps 116 of the bottom wall 112 of the housing 10. A free end of the contact portion 220 of each terminal 22 is received in a corresponding groove 117 of the rear wall 118. The solder tails 222 of the terminals 22 are exposed beyond the bottom wall 112 of the housing 10. The two LEDs 110 are assembled into the slots 108 of the housing 10 with the solder legs 132 extending through the housing 10 for being soldered to the circuit board.

The housing 10 is received in the front part 402 of the shield 40 with the opening 405 aligned with the cavity 102 of the housing 10 and with the illuminants 130 of the LEDs 110 exposed at the holes 406 of the front plate 403. The holes 416 of each side plate 414 of the rear part 404 of the shield 40 engage with the tabs 410 of each side plate 408 of the front part 402, thereby securely assembling the rear part 404 to the rear of the front part 402. At the same time, a free end of the spring portion 314 of the spring part 304 abuts against an inner surface of the side plate 408 of the front part 402.

In use, when an RJ-45 plug connector is inserted into the modular jack connector 1, the actuating portion 306 of the block part 302 is pushed sideways by the RJ-45 plug connector, thereby compressing the spring portion 314 of the spring part 304. The blocking portion 308 simultaneously moves sideways, retracting from the upper part 1022 of the cavity 102 thereby allowing the RJ-45 plug connector to enter into the cavity 102 of the housing 10.

However, when an RJ-11 plug connector (not shown) is erroneously inserted though the opening 405, it is blocked from full insertion. A first width is defined between an inner side of the actuating portion 306 of the block part 302 and the left side wall 105 of the housing 10. Since the RJ-11 plug connector (not shown) has a second width smaller than the first width, the inserted RJ-11 plug connector will not push the actuating portion 306 aside, and insertion of a latch of the RJ-11 plug connector into the upper part of the cavity 102 is prevented by the blocking portion 308 projecting into the upper part 1022 of the cavity 102. Thus, the RJ-11 plug connector is blocked from full insertion by the blocking portion 308 of the anti-mismating device 30.

It is to be understood, however, that even though numerous characteristics and advantages of the present invention have been set forth in the foregoing description, together with details of the device and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector adapted for mating with a first complementary plug connector, comprising:

a housing defining a cavity therein, a first part of said cavity for receiving a first member of the complimentary plug connector, and a second part of said cavity for receiving a second member of the complementary plug connector;

a terminal insert assembled into said housing with terminals extending into said cavity;

anti-mismating means arranged in said housing for blocking insertion of a second plug connector, said second plug connector having first dimensions that differ from those of said complimentary plug connector;

said anti-mismating device comprises a block part having an actuating portion extending into said first part of the cavity, a blocking portion extending into said second part of cavity; and wherein an insertion of the first complementary plug connector into the cavity first moves the actuating portion out of the first part of the cavity, and the movement of the actuating portion then moving the blocking portion of the block part out of the second part of the cavity;

wherein a first width is define across said first part of said cavity between said actuating portion and a wall of opposite the actuating portion, the first width being bigger than a width of the second plug connector so that during an attempted insertion of the second plug connector into said cavity, the second plug connector fits between the actuating portion and the wall of the housing opposite the actuating portion so that the second plug connector does not move the actuating portion out of the first part of the cavity and movement of the second plug connector into the second part of the cavity is blocked by said blocking portion located in the second part of said cavity;

wherein said anti-mismating means further includes a biasing device for keeping said actuating portion and said blocking portion is said first and second parts of the cavity;

wherein the biasing device is a spring part comprising a securing portion securing on a channels of the housing and a spring portion extending from the securing portion and being received in the block part.

* * * * *